US006347539B1

(12) United States Patent
Sekido

(10) Patent No.: US 6,347,539 B1
(45) Date of Patent: Feb. 19, 2002

(54) BENDING METHOD FOR PIPE MATERIAL

(75) Inventor: Yutaka Sekido, Aichi-ken (JP)

(73) Assignee: Sango Co. Ltd., Naogya (JP)

( * ) Notice: Subject to any disclaimer, the term of this patent is extended or adjusted under 35 U.S.C. 154(b) by 0 days.

(21) Appl. No.: 09/646,650

(22) PCT Filed: Jan. 20, 2000

(86) PCT No.: PCT/JP00/00252

§ 371 Date: Sep. 20, 2000

§ 102(e) Date: Sep. 20, 2000

(87) PCT Pub. No.: WO00/43143

PCT Pub. Date: Jul. 27, 2000

(30) Foreign Application Priority Data

Jan. 21, 1999 (JP) ..... 11-012634

(51) Int. Cl.[7] ..... B21D 9/00

(52) U.S. Cl. ..... 72/369; 72/150; 72/309; 72/310; 72/370.01; 72/398

(58) Field of Search ..... 72/150, 308, 309, 72/310, 369, 370.01, 370.04, 394, 398

(56) References Cited

U.S. PATENT DOCUMENTS

| | | | | | |
|---|---|---|---|---|---|
| 1,308,591 A | * | 7/1919 | James | | 72/398 |
| 2,675,049 A | * | 4/1954 | Martin | | 72/398 |
| 3,017,914 A | * | 1/1962 | Fuchs, Jr. | | 72/398 |
| 3,328,996 A | | 7/1967 | Pin et al. | | 72/301 |
| 3,416,351 A | * | 12/1968 | Thielsch | | 72/398 |
| 4,135,380 A | * | 1/1979 | Olszewski et al. | | 72/369 |
| 5,483,809 A | | 1/1996 | Nishiie et al. | | 72/150 |

FOREIGN PATENT DOCUMENTS

| | | | | |
|---|---|---|---|---|
| JP | 31-005068 | | 6/1956 | |
| JP | 55-010328 | | 1/1980 | |
| JP | 61-137629 | * | 6/1986 | 72/369 |
| JP | 63-192519 | | 8/1988 | |
| JP | 8-117857 | | 5/1996 | |
| JP | 9-112755 | | 5/1997 | |

OTHER PUBLICATIONS

"Working Technique of Bending Pipe at Radius 0", Journal Of The Japan Society For Tehcnology Of Plasticity, vol. 35, No. 398 pp. 341–346.

* cited by examiner

*Primary Examiner*—Ed Tolan
(74) *Attorney, Agent, or Firm*—Pillsbury Winthrop LLP

(57) ABSTRACT

In a method of bending a pipe material, in order to use an apparatus, such as a press, and prevent the pipe material from being made thin and cracks from being generated, one side of a cylindrical pipe material is firmly held by a first clamp and another side thereof is loosely held by a second clamp. The clamp is relatively moved downward with respect to the clamp. At this time, pressing force is applied to the pipe material in an axial direction from both ends thereof. The pipe material is plastically deformed by being guided by one quarter spherical surface of a first mandrel and one quarter spherical surface of a second mandrel, whereby two bent portions and an intermediate straight portion are formed.

10 Claims, 9 Drawing Sheets

BENDING METHOD FOR PIPE MATERIAL

This application is the national phase of international application PCT/JP00/00252 filed Jan. 20, 2000 which designated the U.S.

FIELD OF THE INVENTION

The present invention relates to a bending method of a pipe material.

DESCRIPTION OF RELATED ART

As a technique of bending a pipe material (a work) at a significantly small bending radius, "Working Technique of Bending Pipe at Radius 0" is disclosed in JOURNAL OF THE JAPAN SOCIETY FOR TECHNOLOGY OF PLASTICITY Vol. 35 No. 398 pages 341 to 346.

This prior art relates to a method of continuously bending a pipe in a shearing direction by applying an internal pressure p to the pipe (a pipe material) 1A held within two sets of clamps 2A and 3A by an oil 4A and by sliding both of clamps with each other on a boundary surface, as shown in FIGS. 10A to 10C, whereby a bent portion at a minimum radius can be obtained. A crank-like bent product is used as it is or is separated into two parts having the same shape for obtaining two pieces at the same time so as to be used.

In another prior art, Japanese Patent Unexamined Publication No. 6-238352, as shown in FIGS. 11A and 11B, there is disclosed a method of bending a metal pipe at a small radius of curvature in accordance with a mechanical structure by inserting a mandrel 4B having a front end portion formed in a curved surface (a guide surface) shape into a pipe 1B and relatively rotating both of the clamps 2B and 3B around a boundary line.

In the former of the prior arts mentioned above, since the bent portion is the minimum radius obtained by substantially perpendicularly bending, there is a problem that the bent portion increases a fluid resistance in the case of using the bent product as a fluid pipe. Further, when using it as a structural member, there is a problem that a stress concentration is generated in the bent portion so as to form a breakage start point. Further, since the internal pressure is applied by the oil, there is a problem that a pressure application apparatus is required. Further, since steps of charging and discharging the oil are required, there is a problem that the apparatus is not suitable for a mass production.

Further, in the latter of the prior arts mentioned above, since it is necessary to make a rotatable exclusive clamp, there are problems that it is disadvantageous in a manufacturing cost and a set-up time, or it is impossible to obtain two pieces at the same time.

SUMMARY OF THE INVENTION

An object of the present invention is to provide a bending method of a pipe material which can solve the problems mentioned above.

In order to achieve the objects mentioned above, in accordance with the present invention, there is provided a bending method of a pipe material comprising the steps of:

firmly holding a pipe material by a first clamp as well as loosely holding by a second clamp;

arranging mandrels inserted from both ends of the pipe material within the pipe material in such a manner as to be brought into contact with a portion near a boundary surface of both of the clamps or closely oppose to the portion, thereby fixing it so as not to relatively move with respect to both of the clamps; and relatively moving both of the clamps in parallel to the boundary surface in an opposite direction to each other, while maintaining the fixing state, whereby two bent portions and an intermediate straight portion are formed in the pipe material.

Both of the mandrels are firmly fixed so that the position with respect to the clamps does not move until the bending process is finished, after being arranged and fixed. This is the reason for maintaining a clearance (an interval at which the pipe material is plastically flowed) between the mandrel and the clamp constant.

Further, in accordance with the present invention, with respect to the mandrel, the structure may be made such as to insert a front end of a first mandrel inserted to the first clamp via the pipe material into the second clamp, to insert a front end of a second mandrel inserted to the second clamp via the pipe material into the first clamp, and to constitute the front end portions of the respective mandrels by flat surfaces including a pipe axis and a curved surface being convex to a side opposite to the relative moving direction at a time of processing of the clamp to which the front end is inserted, both flat surfaces being brought into contact with or closely opposed to each other at a time of process starting, and to form a space in which the front ends of both of the mandrels can relatively move due to a relative movement of both of the clamps, in both of the clamps.

Further, in accordance with the present invention, it is possible to bend the pipe material while applying a pressing force in an axial direction to the pipe material.

The pressing force applied to the pipe material serves to assist a plastic fluidization of the pipe material at a time of bending.

Further, in the structure mentioned above, the relative movement of both of the clamps and the pressing force of the pipe material close to the second clamp may be obtained by a common power.

Further, in accordance with the present invention, the structure may be made such that both of the clamps and a slider are arranged between an upper table and a lower table which can relatively move close to each other and apart from each other, a relative movement of both of the clamps and a relative movement of the slider are achieved by an approaching force between the upper table and the lower table, and the pipe material close to the second clamp is pressed in accordance with the relative movement of the slider.

BRIEF DESCRIPTION OF THE DRAWINGS

FIGS. 1A and 1B are schematic views which show a first embodiment in accordance with the present invention, in which FIG. 1A shows a state immediately before processing and FIG. 1B shows a state during processing;

DESCRIPTION OF THE PREFERRED EMBODIMENTS

Figure 1A:
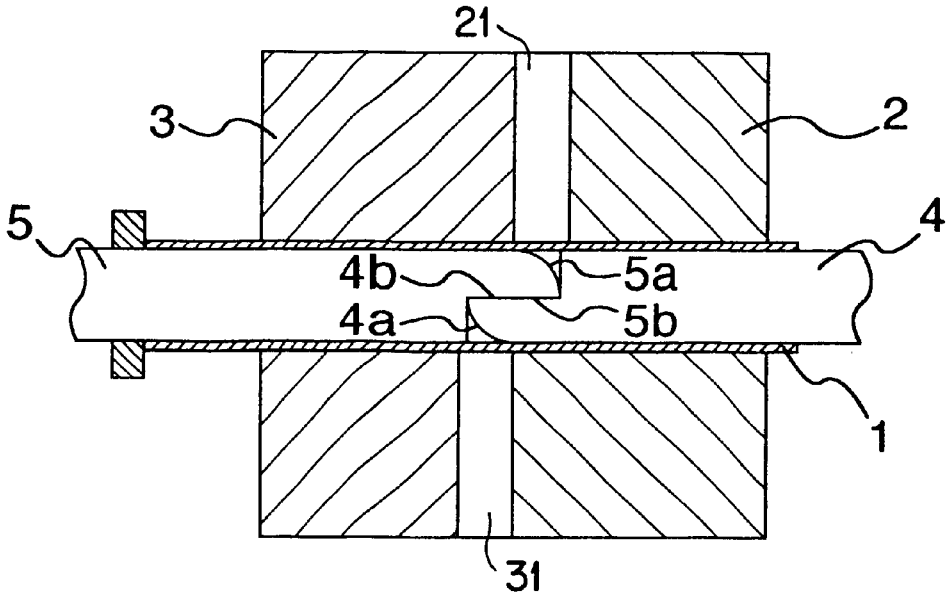
Figure 1B:
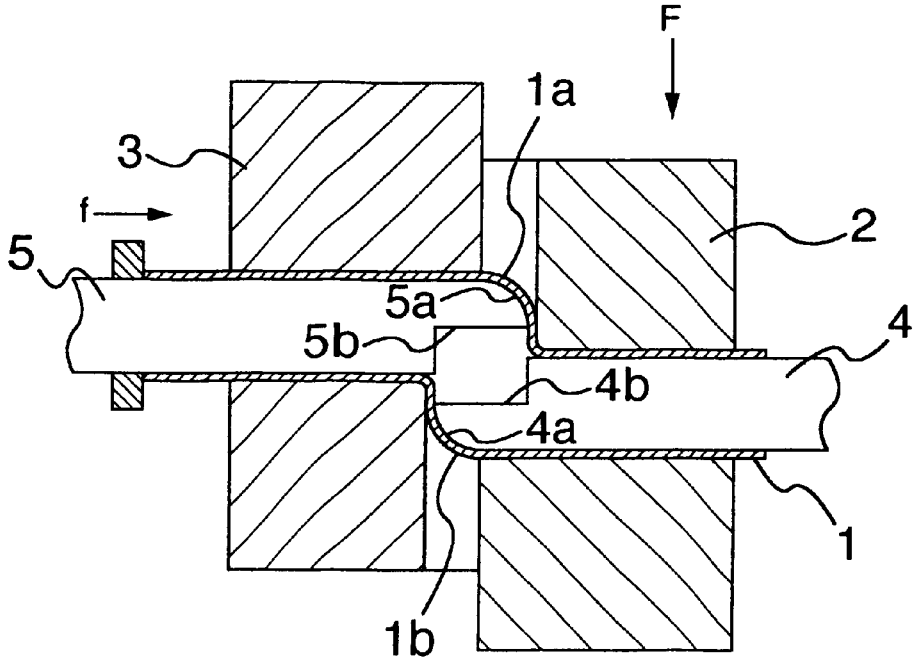

FIGS. 1A and 1B are schematic views which show a first embodiment of a bending method of a pipe material in accordance with the present invention. A pipe material 1 is a cylindrical metal straight pipe and a right half thereof is firmly held by a first clamp 2. Further, a left half of the pipe material is loosely held by a second clamp 3.

Mandrels 4 and 5 are respectively inserted into the pipe material from a left end and a right end of the pipe material 1, as shown in FIG. 1A, and front ends of both of the mandrels are brought into contact with each other near a boundary surface of both of the clamps 2 and 3.

The mandrel 4 is structured such that a front end portion (a left end portion in the drawing) of the mandrel is constituted by one quarter spherical surface 4*a* protruded downward, and a flat surface 4*b* including a pipe axis, and another portion (a right portion in the drawing) is constituted by a cylindrical shape having an outer diameter capable of being tightly inserted to an inner diameter of the pipe material 1. In this case, the mandrel 4 is directly or indirectly fixed to the first clamp 2 in such a manner as not to relatively move.

The mandrel 5 has one quarter spherical surface 5*a* protruded upward and formed in a right end portion thereof, a flat surface 5*b* including a pipe axis, and a cylindrical portion having an outer diameter capable of being tightly inserted to the inner diameter of the pipe material 1, and the front ends of both of the mandrels are arranged in a state that the flat surface 5*b* is brought into contact with the flat surface 4*b* of the mandrel 4. In this case, the mandrel 5 is directly or indirectly fixed to the second clamp 3 in such a manner as not to relatively move.

The spherical surfaces 4*a* and 5*a* are structured such that a radius of curvature thereof is set to a radius corresponding to an outer diameter of the cylindrical portion of the mandrel, and it is desirable to set a radius of curvature of a ridgeline as directly seen in the front view as illustrated to one third or less of an outer diameter (a diameter) of the cylindrical portion.

In this case, the shape of the curved surfaces of the spherical surfaces 4*a* and 5*a* is not limited to those mentioned above, and may be an optional shape of a curved surface.

Gaps 21 and 31 by which the front ends of both of the mandrels 4 and 5 can relatively move without being brought into contact with the respective clamps in accordance with the relative movement of both of the clamps are formed in both of the clamps 2 and 3. The shape of the gaps may be formed in a semicircular shape corresponding to an outer diameter of the pipe material to be worked, may be formed in a U shape in the same manner, and may be formed in a groove shape having a triangular cross section or the like.

Then, both of the clamps 2 and 3 are relatively moved in a vertical direction in parallel to the boundary surface by pressurizing the first clamp 2 as shown by an arrow F while applying a pressing force f in an axial direction to the pipe material 1. Then, a shearing force is applied to the pipe material near the boundary surface between both of the clamps, and the raw material is plastically fluidized. At a time of fluidizing, since the fluidization is guided to the front end portion of the mandrel and the fluidization is smoothly performed by being assisted by the pressing force f, it is possible to prevent a thickness from being made thin and a crack from being generated, and it is possible to form a shape bent along an outer diameter of the mandrel.

In accordance with the process mentioned above, it is possible to produce a crank-like pipe in which two bent portions 1*a* and 1*b* are formed.

Next, a description will be given of a preferred embodiment in accordance with the present invention on the basis of a bending method of a pipe material performed by a bending apparatus shown in FIGS. 2 and 3.

Figure 2:
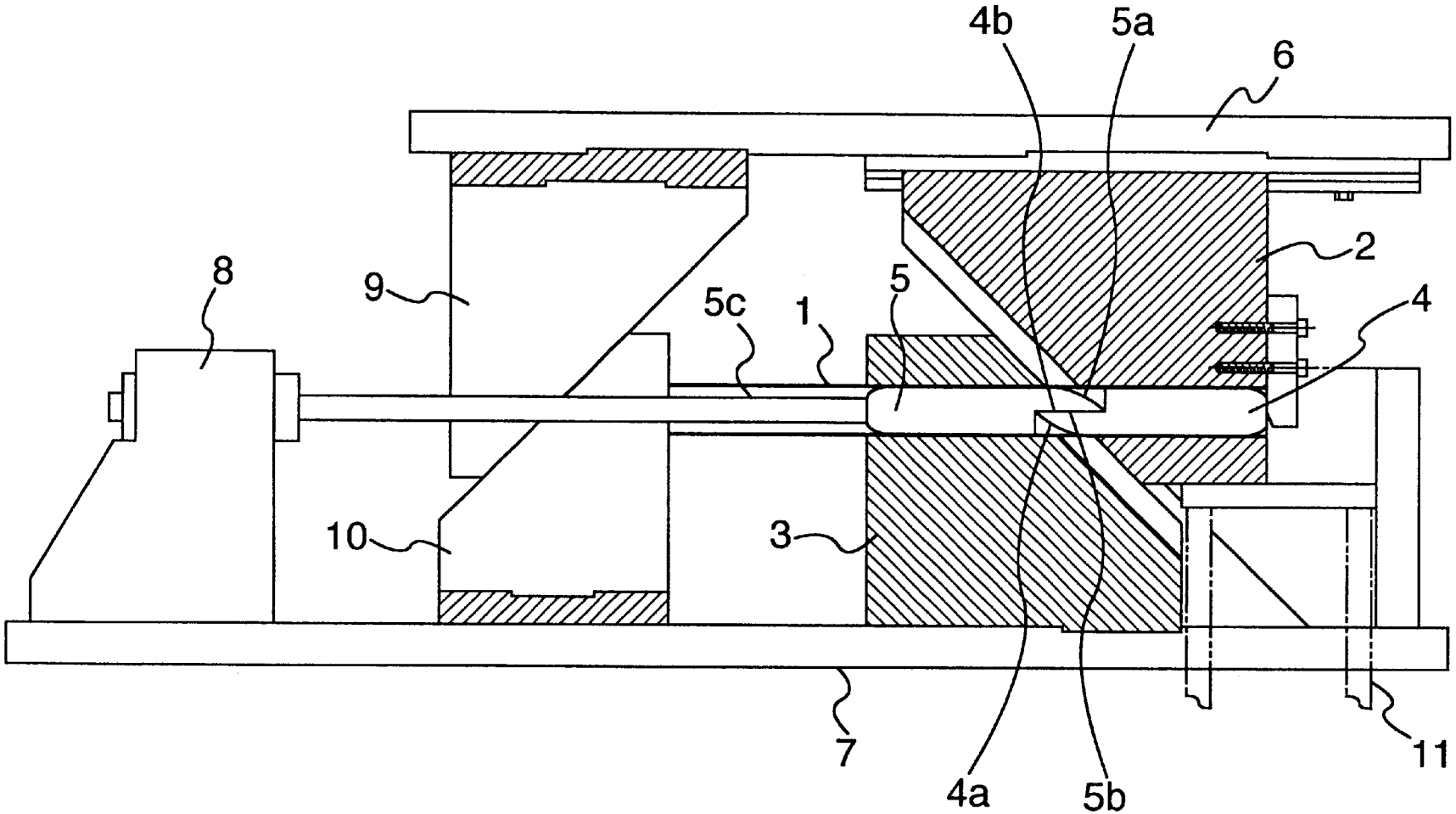
FIG. 2 is a front view which shows a state immediately before processing in a second embodiment in accordance with the present invention.
Figure 3:
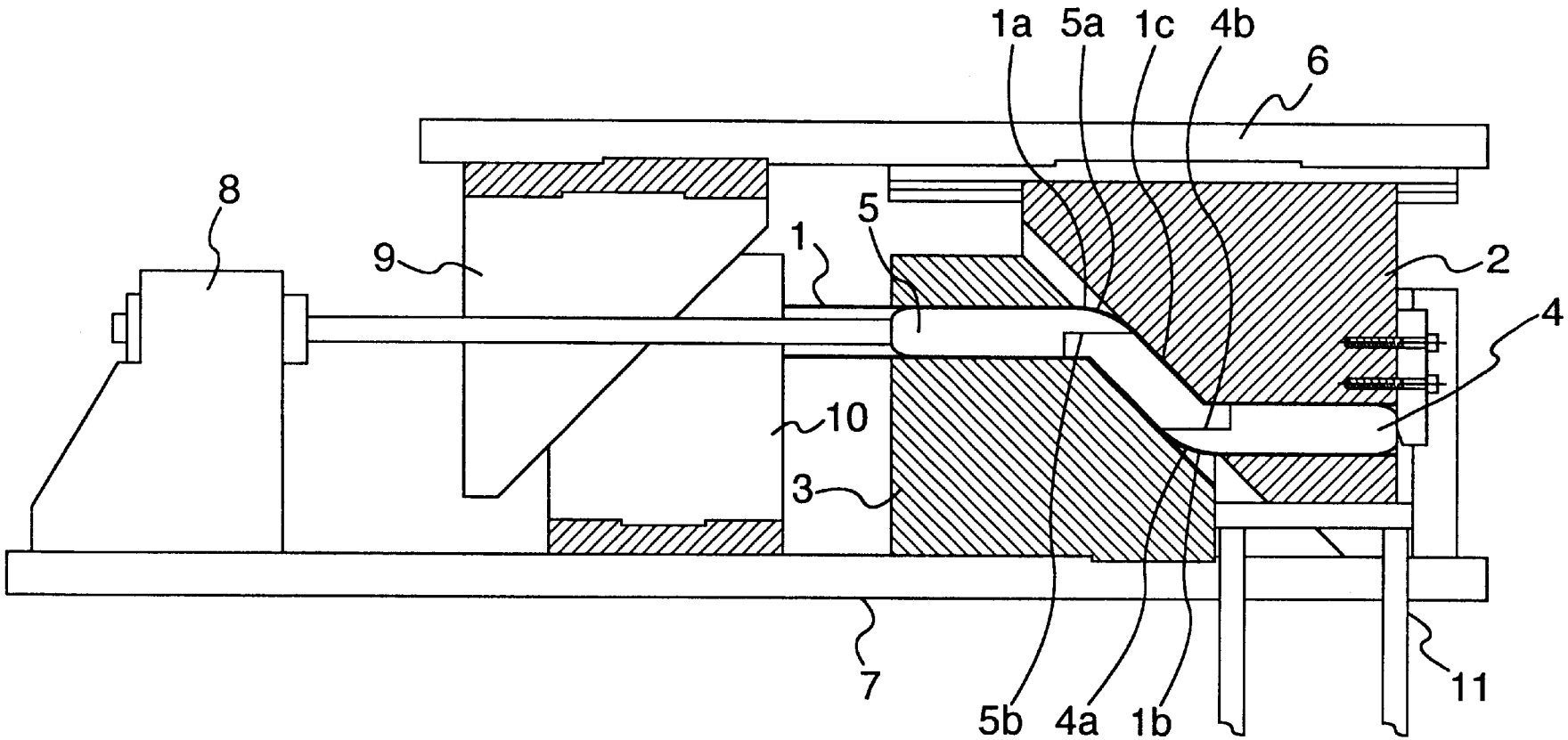
FIG. 3 is a view which shows a state during processing in the embodiment shown in FIG. 2.
Figure 4:
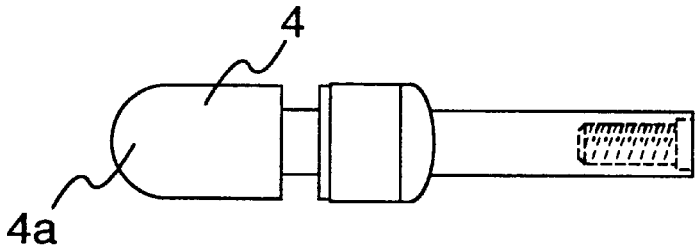
FIG. 4 is a bottom view of a mandrel 4.

In both of FIGS. 2 and 3, the cylindrical metal pipe material 1 is firmly held by the first clamp 2 mounted to an upper table 6 and loosely held by the second clamp 3 mounted to a lower table 7. For the upper table 6 and the lower table 7, an upper table and a lower table of a popular press apparatus are used.

The mandrel 4 is attached to the first clamp at a right end in a state of being inserted to the pipe material 1. Further, the mandrel 5 is inserted to the pipe material 1, and a left end of a left end rod portion 2*c* is urged rightward in the drawing in accordance with a suitable force given by a pressing mechanism 8 provided in the lower table 7.

For sliders 9 and 10 mounted to the upper table 6 and the lower table 7, an existing general slider mechanism used for a press working is used, and the pipe material 1 is pressed in a rightward direction in the drawing by the slider mechanism.

When moving downward the upper table 6 from a state shown in FIG. 2, the slider 10 moves rightward in accordance with an inclined surface of the sliders 9 and 10 having an inclination of 45 degrees, and is displaced as shown in FIG. 3. Then, the first clamp 2 also moves downward, moves to a right and lower portion in parallel to the boundary surface with respect to the clamp 3 and is displaced as shown in FIG. 3. At this time, the clamp 2 also slides rightward along the upper table 6. In accordance with this process, the pipe material 1 is worked, and two bent portions 1*a* and 1*b* and a straight portion 1*c* formed in the middle of these bent portions are formed as shown in FIG. 3.

As is apparent from the description mentioned above, the curved surface constituted by one quarter spherical surface 4*a* of the mandrel 4 and the curved surface constituted by one quarter spherical surface 5*a* of the mandrel 5 are respectively formed so as to be protruded to a side opposite to a moving direction (that is, a vertical direction) at a time of working, and it is apparent from the description of FIGS. 1A and 1B mentioned above that the curved surfaces are advantageously utilized for plastically forming the pipe material.

In this case, reference numeral 11 denotes a well-known cushion for elastically supporting the lower portion of the first clamp 2. Further, in the embodiment, a grip portion of the first clamp (for firmly holding) is a straight pipe, however, the grip portion is not required to be always the straight pipe and any shape may be employed as far as it can grip. For example, when grooves for gripping are cut within the clamp, it is possible to grip. It is also possible to arrange a portion to be bent adjacent to the already bent portion.

Figure 5:
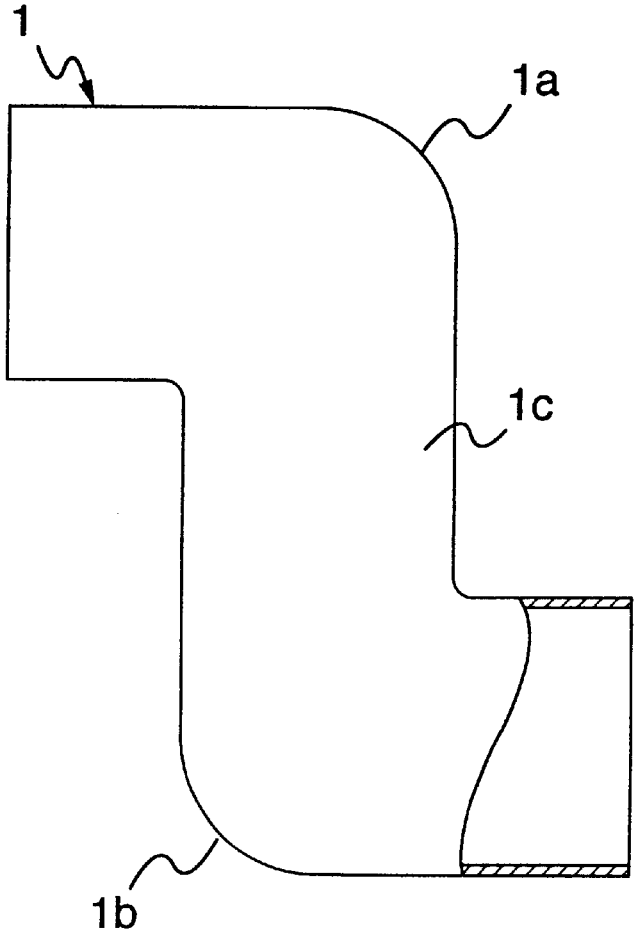
FIG. 5 is a front view of a product produced by an apparatus having a structure shown in FIG. 1.

FIG. 5 shows an embodiment of a product worked in accordance with the first embodiment shown in FIG. 1 mentioned above. The product corresponds to a product in which the straight pipe portion 1*c* is 90 degrees bent with respect to the original pipe material 1 so as to form a crank shape.

Figure 6:
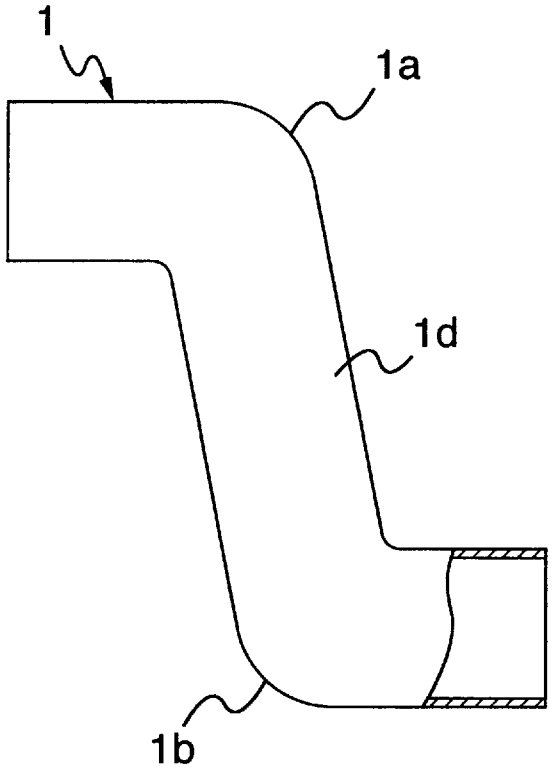
FIG. 6 is a front view of a product produced by the second embodiment shown in FIGS. 2 and 3.

FIG. 6 shows an embodiment of a product worked in accordance with the second embodiment shown in FIGS. 2 and 3 mentioned above. The product corresponds to a crank-like product in which a straight pipe portion 1*d* is inclined with respect to the pipe material 1.

Figure 7:
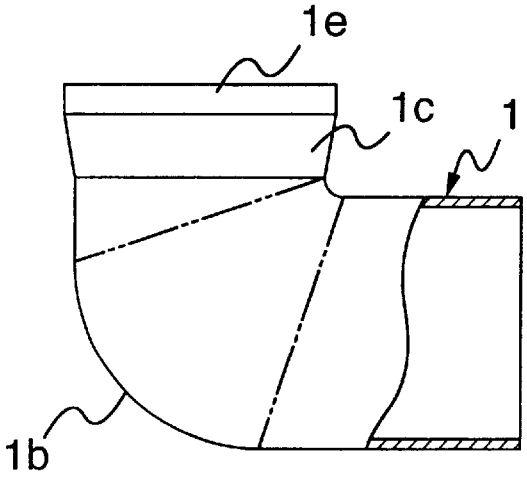
FIG. 7 is a front view of a finished product obtained by picking two products shown in FIG. 5 in one unit.

FIG. 7 shows an embodiment in which two L-shaped products having the same shape are picked by cutting the pipe produced as shown in FIG. 5 mentioned above in an intermediate portion of the straight pipe portion 1*c* into two pieces and expanding a cut portion 1*e* by a punching or the like.

In this case, in the first and second embodiments mentioned above, the structure is made such that the movement of the clamps 2 and 3 and the pressing of the pipe material 1 are performed by the movement of the upper table 6, and the structure is not limited to this, and the movement of the clamps 2 and 3 and the pressing of the pipe material 1 may be controlled by using an optional power. In particular, in the case of producing a small number of products which do not require the sliders 9 and 10 and in the case that there is no room for arranging the equipment mentioned above, respective movements may be accurately controlled, for example, by a hydraulic, air or motor-driven cylinder or the like.

Figure 8A:
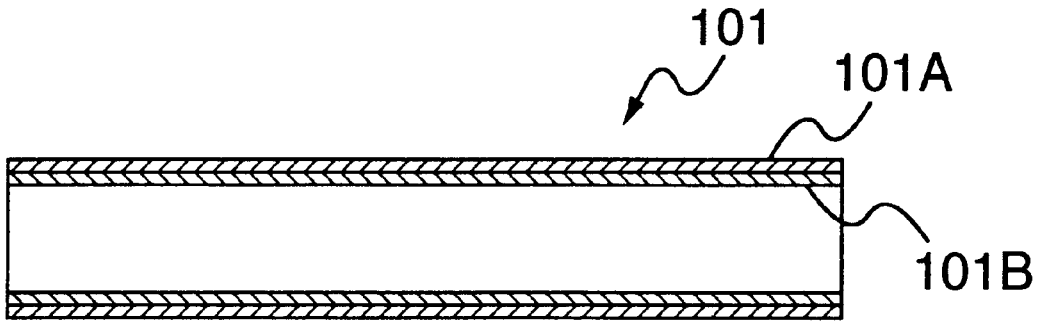
FIGS. 8A and 8B are front views which show a state before processing and a state after processing of another pipe material produced by the apparatus having the structure shown in FIG. 1.
Figure 8B:
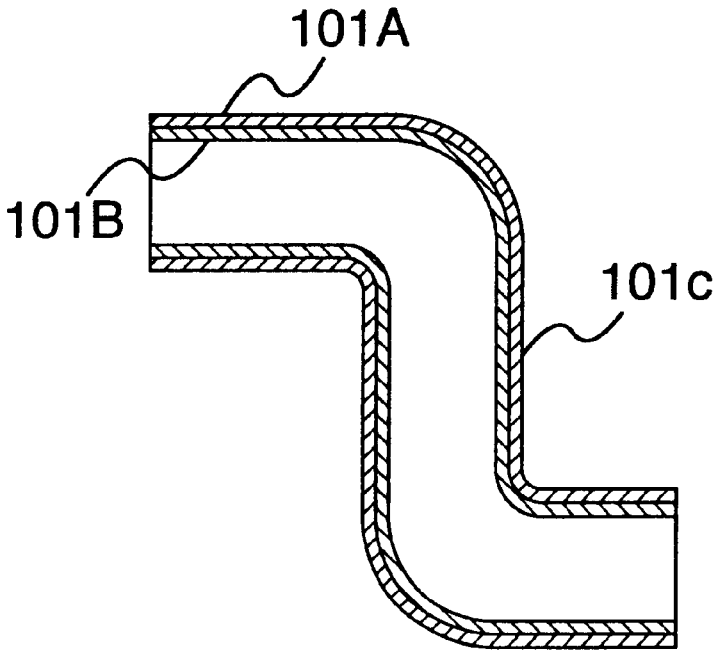

FIGS. 8A and 8B show a modified embodiment of the product worked in accordance with the first embodiment shown in FIG. 1 mentioned above. The product in this case corresponds to a product obtained by changing the pipe material 1 of the first embodiment to a double-layered pipe 101 in which an outer pipe 101A and an inner pipe 101B are closely attached to each other and working the double-layered pipe 101 in the same manner as that of the first embodiment, thereby bending a straight pipe portion 101*c* at an angle of 90 degrees with respect to the original double-layered pipe 101 so as to form a crank shape.

Figure 9A:
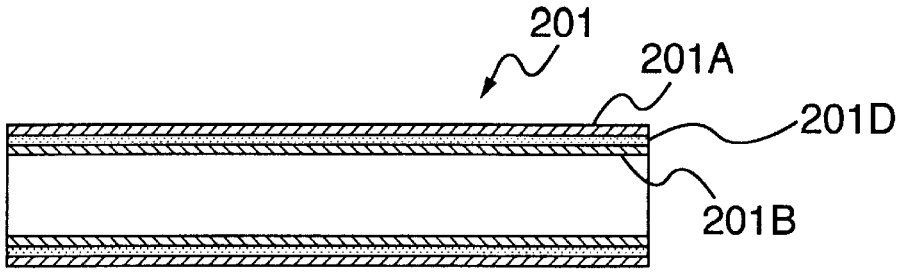
FIGS. 9A, 9B and 9C are front views which show a state before processing, a state after processing and a state of removing an interposed material of the other pipe material produced by the structure shown in FIG. 1.
Figure 9B:
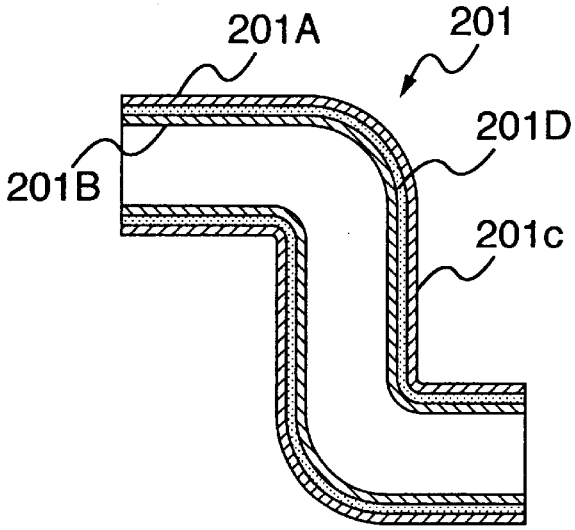
Figure 9C:
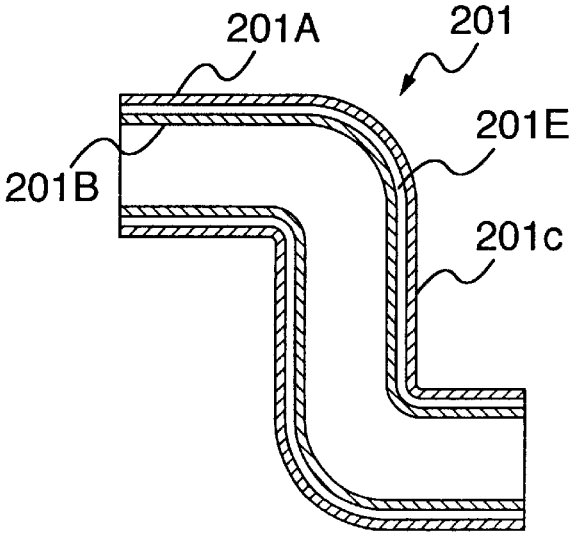
Figure 10A:
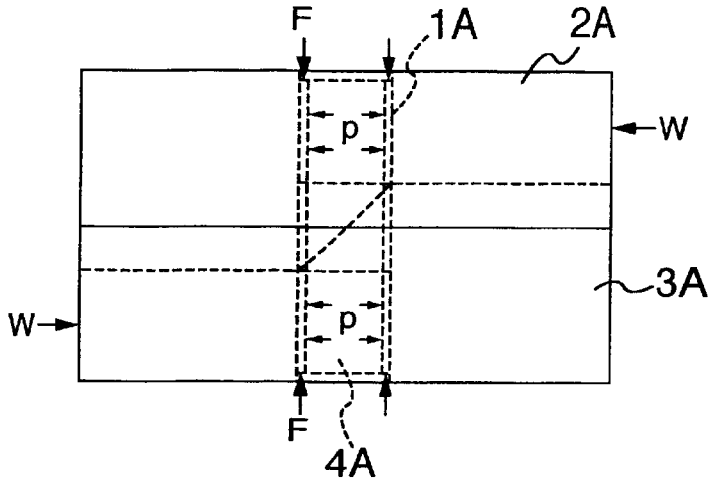
FIG.10A (RELATED ART)
FIGS. 10A, 10B and 10C are views which show an embodiment of a conventional bending method of a pipe.
Figure 10B:
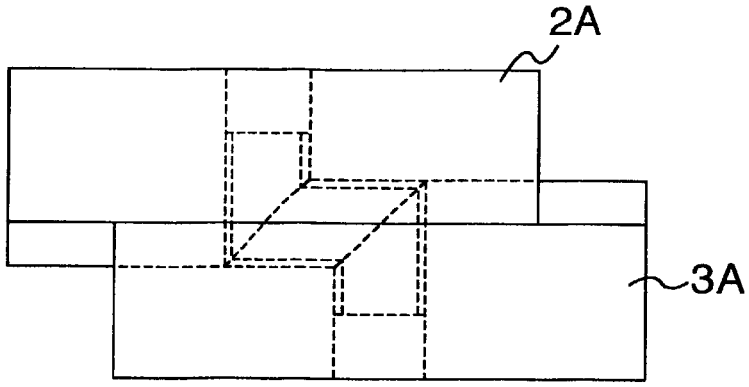
FIG.10B (RELATED ART)
Figure 10C:
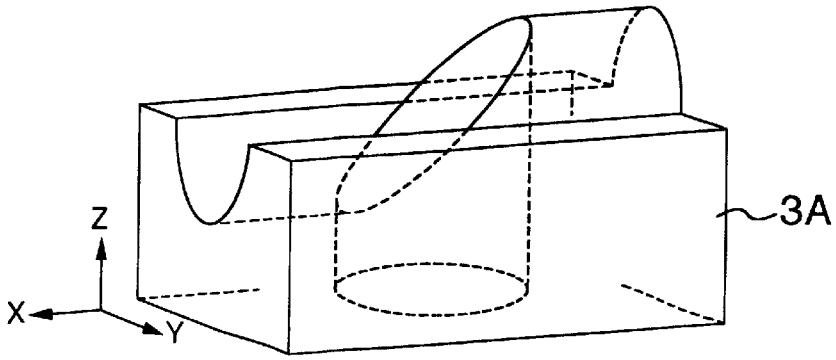
FIG.10C (RELATED ART)
Figure 11A:
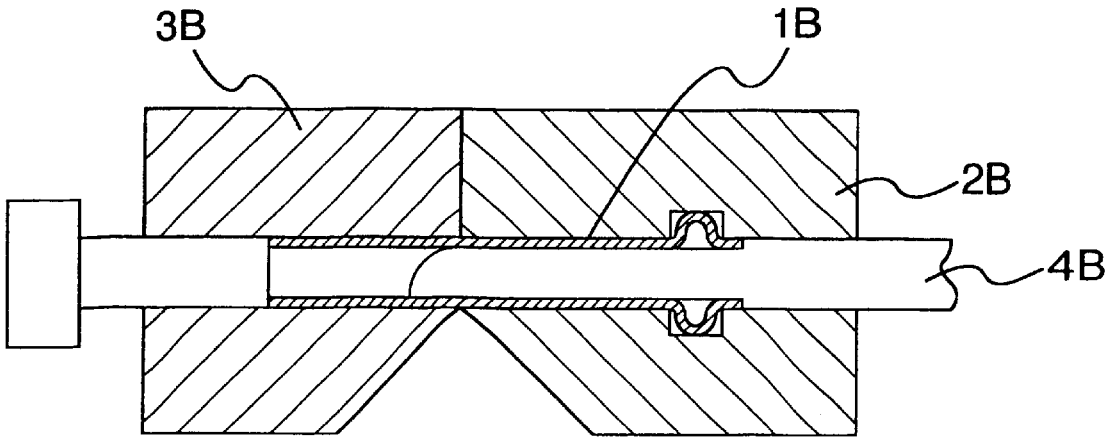
FIG.11A (RELATED ART)
FIGS. 11A and 11B are views which show another embodiment of the conventional bending method of the pipe.
Figure 11B:
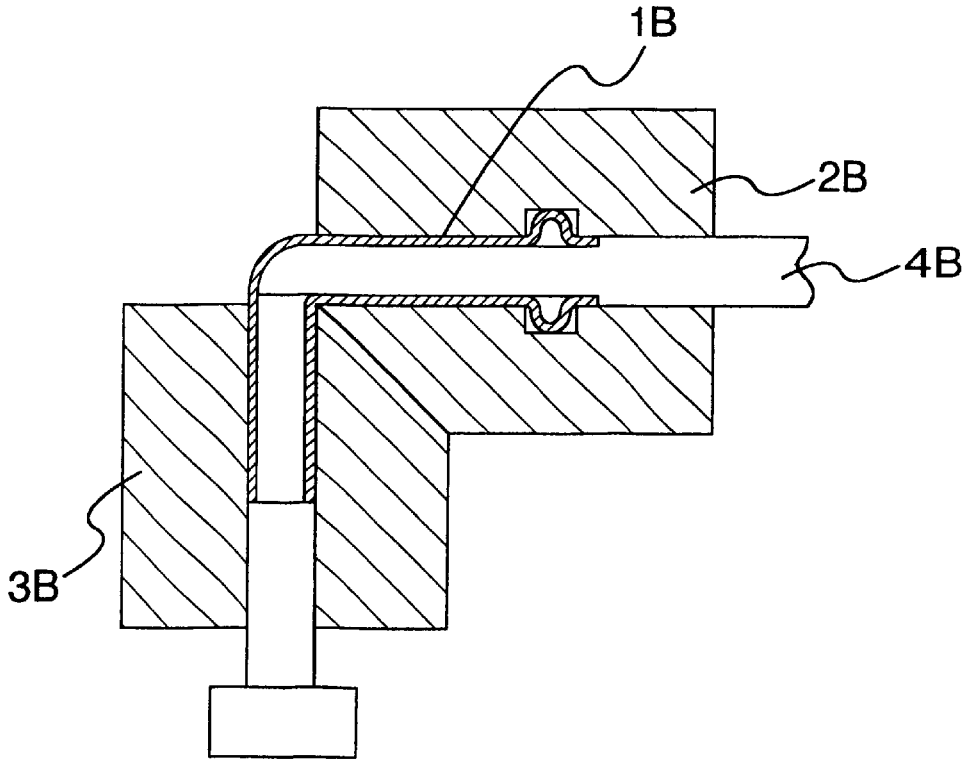
FIG.11B (RELATED ART)

FIGS. 9A, 9B and 9C show an embodiment obtained by further modifying the modified embodiment shown in FIGS. 8A and 8B. The product in this case corresponds to a product obtained by using a double-layered pipe 201 in which a non-compressible interposed material 201D is charged between an outer pipe 201A and an inner pipe 201B, in place of the double-layered pipe 101, as shown in FIG. 9A, bending the double-layered pipe closely attached to each other via the interposed material at a stroke in the same manner as that of the modified embodiment shown in FIGS. 8A and 8B so as to form a shape obtained by bending a straight pipe portion 201*c* at an angle of 90 degrees with respect to the original double-layered pipe 201 in a crank-like manner, as shown in FIG. 9B, and thereafter taking out the interposed material 201D within the double-layered pipe, as shown in FIG. 9C, thereby forming a gap 201E.

As the interposed material 201D, for example, a heat melting resin is employed, and a charging operation is performed by holding the inner and outer pipes 201A and 201B by suitable means so that the predetermined gap 201E is formed therebetween, closing one end of the gap 201E by suitable means, pouring a resin in a heated and melted state into the gap from another open end, and cooling and solidifying the resin so as to interpose the resin between the inner and outer pipes 201A and 201B as the solid interposed material 201D.

This interposed material 201D has good charging property and discharge property, and is desirably structured such as to be capable of deforming at a certain degree in the case of being charged and solidified and have a small compression property (a non-compression property can be employed). Accordingly, the heat melting resin mentioned above is desirable, however, the other resins than this resin may be employed. Further, the interposed material may employ a heat plastic resin.

Further, the interposed material may employ an ice obtained by freezing a water poured into the gap 201E, and may further employ a metal powder (shot) In addition, it is possible to employ a material which is changed into a solid or a liquid due to heat, for example, molten salt such as a nitrate, a nitrite or the like, a metal having a low melting point and a compound thereof.

INDUSTRIAL APPLICABILITY

In accordance with the working method of the pipe material, the first clamp firmly holding one side of the pipe material and the second clamp loosely holding another side thereof move to opposite sides to each other with respect to the boundary surface. Accordingly, a shearing force is applied to the pipe material near the boundary surface and the material is plastically fluidized. Since the fluidization is guided by the curved surface in the mandrel front end portion at a time of fluidizing, the curved shape along the outer shape of the front end portion of the mandrel is obtained without making the thickness thin and generating a crack.

Further, in the mandrel mentioned above, in the case of inserting a front end of a first mandrel inserted to the first clamp via the pipe material into the second clamp, inserting a front end of a second mandrel inserted to the second clamp via the pipe material into the first clamp, constituting the front end portions of the respective mandrels by flat surfaces including a pipe axis and a curved surface being convex in a side opposite to the relative moving direction at a time of working of the clamp to which the front end is inserted, the both flat surfaces being brought into contact with or closely opposed to each other at a time of processing starting, and forming a gap in which the front ends of both of the mandrels can relatively move due to a relative movement of both of the clamps, in both of the clamps, the mandrel front end portion protrudes to the opposing side area over the boundary surface, the protruding portion has the curved surface having the same radius as that of the pipe material, and the curved surface is arranged so as to protrude in the opposite side to the moving direction and guide the plastic fluidization of the pipe material, so that the plastic fluidization becomes further smooth and it is possible to easily produce a product (a worked product) having the curved portion having the same minimum radius as the radius of the pipe material.

Further, in the case of bending while applying the pressing force in an axial direction to the pipe material, the pressing force assists the plastic fluidization of the material so as to make more smooth, so that it is possible to securely prevent the surface from being made thin and the cracks and wrinkles.

Further, in the case of obtaining the relative movement of both of the clamps and/or the pressing force of the pipe material close to the second clamp by the common power, since the common power is employed, it is not necessary to independently provide the power apparatus and the drive apparatus, so that a low cost and a high reliability can be achieved.

Further, in the case that both of the clamps and a slider are arranged between an upper table and a lower table which can relatively move close to each other and apart from each other, a relative movement of both of the clamps and a relative movement of the slider are achieved by an approaching force between the upper table and the lower table, and the pipe material close to the second clamp is pressed in accordance with the relative movement of the slider, since it is possible to achieve the object mentioned above by commonly employing a general apparatus which can optionally move the upper table and the lower table close to each other and apart from each other such as the press apparatus, and a slider mechanism popular in the press formation, the existing equipment and method can be employed, so that it is significantly economic.

What is claimed is:

1. A method of bending a pipe material, comprising:

firmly holding a pipe material by a first clamp which is one of at least two clamps arranged in a longitudinal direction of the pipe material and loosely holding the pipe material by a second clamp;

arranging first and second mandrels inserted from opposite ends of the pipe material within the pipe material so as to be brought into contact with each other or closely confront each other near a boundary surface between the first and second clamps, thereby fixing the mandrels so as not to relatively move with respect to the first and second clamps; and relatively moving the first and second clamps parallel to the boundary surface in an opposite direction to each other while maintaining the fixing state, whereby two bent portions and an intermediate straight portion are formed in the pipe material.

2. A method as claimed in claim 1, wherein a front end of said first mandrel is inserted to the first clamp via the pipe material into the second clamp, a front end of said second mandrel is inserted to the second clamp via the pipe material into the first clamp, the front ends of the respective first and second mandrels having flat surfaces including a pipe axis and a curved surface being convex to a side opposite to said relative moving direction at a time of moving of the respective clamp to which the respective front end is inserted, said flat surfaces being brought into contact with or closely opposed to each other at a time of arranging the first and second mandrels, and a gap is formed in which the front ends of the first and second mandrels move relative to each other due to a relative movement of the first and second clamps.

3. A method as claimed in claim 1, wherein a bending process is performed while applying a pressing force in an axial direction of the pipe material.

4. A method as claimed in claim 2, wherein a bending process is performed while applying a pressing force in an axial direction of the pipe material.

5. A method as claimed in claim 2, wherein at least one of the relative movement of the first and second clamps and the pressing force are obtained by common power.

6. A method as claimed in claim 3, wherein at least one of the relative movement of the first and second clamps and the pressing force are obtained by common power.

7. A method as claimed in claim 4, wherein at least one of the relative movement of the first and second clamps and the pressing force are obtained by common power.

8. A method as claimed in claim 5, wherein the first and second clamps and a slider are arranged between an upper table and a lower table movable toward and away from each other, the relative movement of the first and second clamps and a relative movement of the slider are achieved by an approaching force between the upper table and the lower table, and the pipe material close to the second clamp is pressed in accordance with the relative movement of the slider.

9. A method as claimed in claim 6, wherein the first and second clamps and a slider are arranged between an upper table and a lower table movable toward and away from each other, the relative movement of the first and second clamps and a relative movement of the slider are achieved by an approaching force between the upper table and the lower table, and the pipe material close to the second clamp is pressed in accordance with the relative movement of the slider.

10. A method as claimed in claim 7, wherein the first and second clamps and a slider are arranged between an upper table and a lower table movable toward and away from each other, the relative movement of the first and second clams and a relative movement of the slider are achieved by an approaching force between the upper table and the lower table, and the pipe material close to the second clamp is pressed in accordance with the relative movement of the slider.

* * * * *